US006264430B1

(12) United States Patent
Hulkkonen et al.

(10) Patent No.: US 6,264,430 B1
(45) Date of Patent: Jul. 24, 2001

(54) EVAPORATING FAN AND ITS BLADE WHEEL

(75) Inventors: Rauli T. Hulkkonen, Espoo; Jyri-Markku Vuorenmaa, Helsinki, both of (FI)

(73) Assignee: ABB Flakt Oy (FI)

( * ) Notice: Subject to any disclaimer, the term of this patent is extended or adjusted under 35 U.S.C. 154(b) by 0 days.

(21) Appl. No.: 09/341,090

(22) Filed: Jul. 2, 1999

(30) Foreign Application Priority Data

Jan. 17, 1997 (FI) ..... 970211

(51) Int. Cl.[7] ..... F04D 29/24; F04D 29/02

(52) U.S. Cl. ..... 416/224; 416/186 R; 416/230; 416/241 A; 416/241 B

(58) Field of Search ..... 416/186 R, 224, 416/229 R, 230, 241 A, 241 B; 62/268

(56) References Cited

U.S. PATENT DOCUMENTS

| | | | | |
|---|---|---|---|---|
| 1,014,321 | | 1/1912 | Minor . | |
| 1,404,849 | * | 1/1922 | Hamilton | 416/224 |
| 1,406,600 | * | 2/1922 | Zahm | 416/224 |
| 1,842,178 | * | 1/1932 | Kempton | 416/224 |
| 1,985,705 | * | 12/1934 | Whiton, Jr. | 416/186 R |
| 2,903,182 | | 9/1959 | Downs . | |
| 3,602,608 | | 8/1971 | Morkey . | |
| 3,915,596 | * | 10/1975 | Frazar | 416/241 A |
| 4,523,896 | | 6/1985 | Lhenry et al. . | |
| 4,676,722 | * | 6/1987 | Marchal et al. | 416/230 |
| 4,746,266 | | 5/1988 | Kirchner et al. . | |
| 4,808,055 | * | 2/1989 | Wertz et al. | 416/224 |
| 4,895,491 | | 1/1990 | Cross et al. . | |
| 5,104,293 | * | 4/1992 | Eaton, Jr. et al. | 416/224 |
| 5,315,838 | * | 5/1994 | Thompson | 62/129 |
| 5,464,325 | * | 11/1995 | Albring et al. | 416/230 |
| 5,520,008 | * | 5/1996 | Ophir et al. | 416/230 |
| 5,538,395 | * | 7/1996 | Hager | 416/186 R |
| 5,599,169 | | 2/1997 | Hauser . | |
| 5,632,601 | | 5/1997 | Bodmer et al. . | |
| 5,775,878 | * | 7/1998 | Maumus et al. | 416/186 R |
| 5,785,498 | * | 7/1998 | Quinn et al. | 416/224 |
| 5,800,128 | * | 9/1998 | Bodmer et al. | 416/230 |
| 5,845,398 | * | 12/1998 | Maumus et al. | 29/889.21 |

FOREIGN PATENT DOCUMENTS

| | | | | |
|---|---|---|---|---|
| 920188 | | 3/1963 | (GB) . | |
| 59-34499 | * | 2/1984 | (JP) | 416/224 |
| 1116187 | * | 9/1984 | (SU) | 416/224 |

OTHER PUBLICATIONS

Patent Abstracts of Japan, vol. 13, No. 373, M–861 abstract of JP 1–125596 A (kubota ltd.), May 18, 1989.

* cited by examiner

*Primary Examiner*—Christopher Verdier
(74) *Attorney, Agent, or Firm*—Nixon & Vanderhye P.C.

(57) ABSTRACT

A mechanical vapor recompression fan comprises a blade wheel and an electric motor to operate the blade wheel. The blade wheel at least mainly consists of carbon-fibre-based composite material and is mounted directly on the shaft of the blade wheel, and the tips of the blades of the blade wheel are provided with an erosion shield.

5 Claims, 3 Drawing Sheets

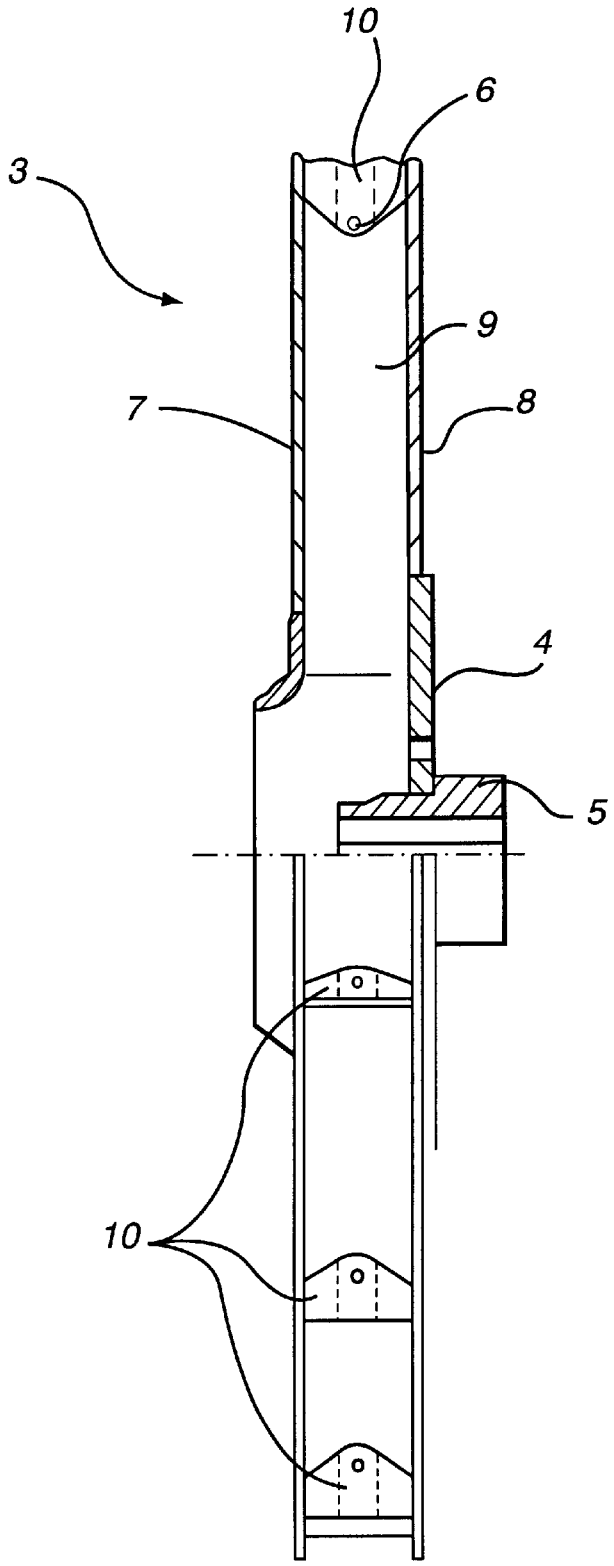
FIG. 2
FIG. 2A
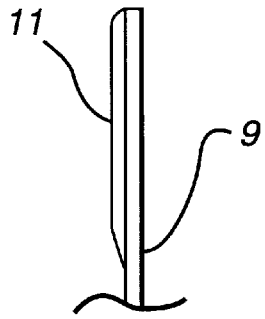

EVAPORATING FAN AND ITS BLADE WHEEL

BACKGROUND AND SUMMARY OF THE INVENTION

The invention relates to an evaporating fan, and in particular to an MVR fan (MVR=Mechanical Vapour Recompression) comprising a blade wheel and an electric motor to operate the blade wheel. The invention also relates to the blade wheel of this evaporating fan.

Evaporating fans are used in treatment plants based on the evaporation technique of various liquids (e.g. waste water) for providing the energy needed in the evaporation process. The energy is provided by raising the pressure of the vapour used as the substance in the process.

With an evaporating fan implemented according to the prior art, having a blade wheel of steel blades with separate roller bearings, it is at best possible to achieve a temperature rise of less than 8° C. at one stage. The evaporating fan is used in processes in which vapour contains impurities and liquid drops, and therefore, the blade wheel has to be dimensioned to resist erosion and wear caused by liquid drops colliding at high speed.

The determining factor in the mechanical implementation of the evaporating fan of the prior art is the weight and strength of the steel blade wheel. Because of the heavy blade wheel compromises have to be made as regards the dimensioning of bearings. The bearings must endure the great stress put on them by the weight of the blade wheel, and also sustain the centrifugal forces resulting from the high rotation speed, and heat production in the roller elements. For the fan to operate smoothly, the critical rotation speed of the rotor system has to be above the operating rotation speed. In practice, this results in such dimensioning in which the roller bearings used are relatively large, and the heat generated in the bearings is led away by means of an effective oil circulation lubricating system.

Due to the above-mentioned features, the existing evaporating fans have to be provided with separate bearings, either roller or slide bearings, since the bearings of the electric motor do not endure the stress caused by a steel blade wheel. As a consequence, the evaporating fan arrangements are large and heavy, and cannot be economically integrated into the arrangements of evaporating plants.

An object of the present invention is to eliminate the drawbacks described above. This is achieved with an evaporating fan of the invention, characterized in that the blade wheel at least mainly consists of carbon-fibre-based composite material and is mounted directly on the shaft of the electric motor, and the tips of the blades of the blade wheel are provided with an erosion shield.

The blade wheel of the invention is comprised of a plurality of blades constructed of carbon-fibre-based composite material, and the tips of the blades are each provided with an erosion shield By making the blade wheel of an evaporating fan or its essential components of carbon-fibre-based composite material the weight of the blade wheel can be reduced to a fraction of the weight of a steel blade wheel. A blade wheel made of this material can be dimensioned to be as strong as the steel blade wheel or even stronger. The light composite blade wheel can be mounted directly on the shaft of a standard electric motor without the stress on the bearings increasing too high. By means of an A/C inverter a fan implemented in this way can be rotated up to the maximum rotation speed given by the manufacturer of the bearings, and thus the pressure and temperature can be raised as high as with the conventional evaporating fan arrangement, or even higher.

Compared with the conventional evaporating fan, the evaporating fan of the present invention allows to dispose of 2 bearings with their casings and circulation lubricating units as well as of couplings between the electric motor and the blade wheel construction since no separate bearings are needed. An arrangement of this kind is compact and very light. It is easy to integrate such a fan into the heat exchanger of an evaporating plant, and thus fewer channels and less space are needed. The composite blade wheel will resist the erosion and wear caused by liquid drops if its critical sections are covered, preferably e.g. with a bent steel plate shield, or coated with appropriate coating, preferably e.g. with ceramic coating.

In the following, the invention will be described in greater detail with reference to the accompanying drawings.

BRIEF DESCRIPTION OF THE DRAWINGS

FIG. 2 shows a partially sectional view of the blade wheel shown in FIG. 1;

FIG. 2A is a partial side elevation (with an end plate removed) illustrating a coated blade tip in accordance with an alternative embodiment of the invention.

DETAILED DESCRIPTION OF THE DRAWINGS

Figure 1:
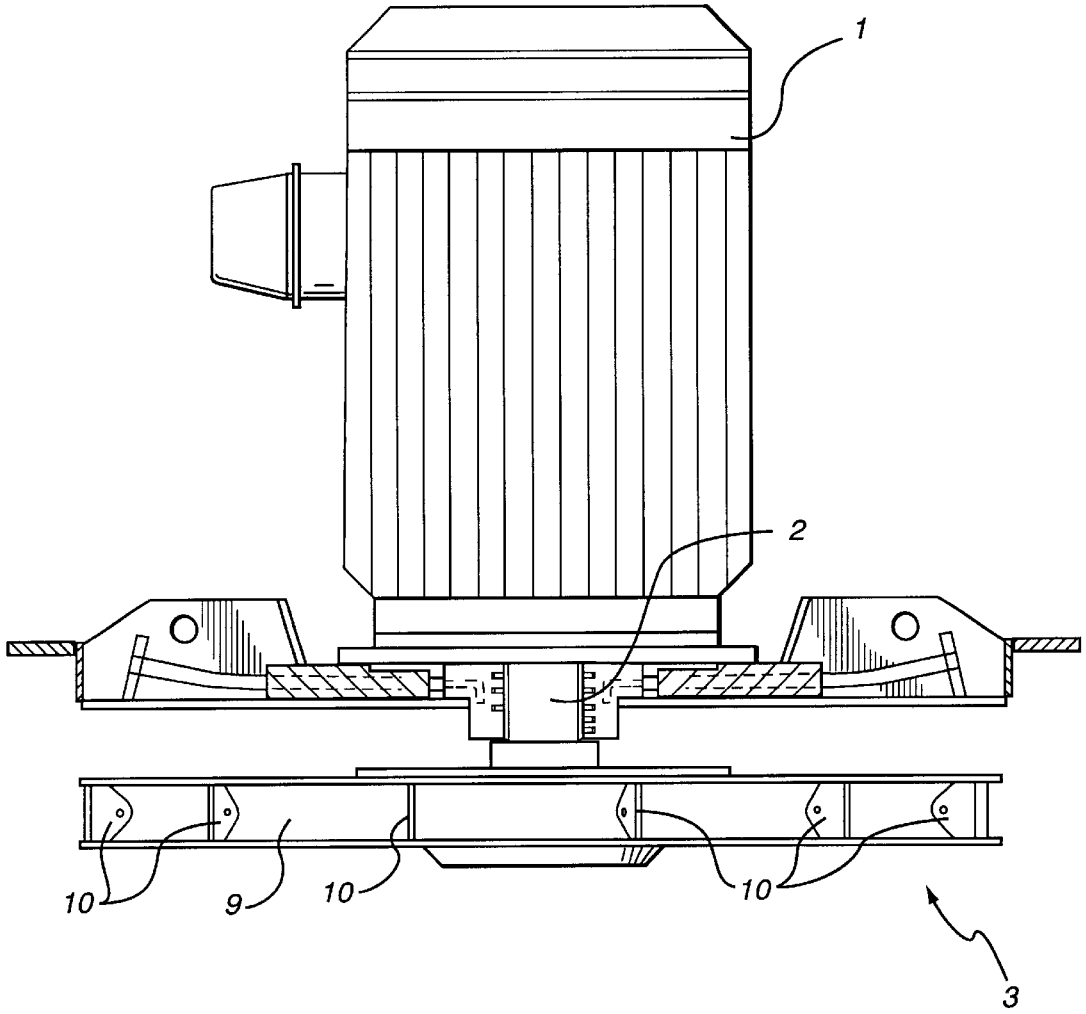
FIG. 1 shows a side view of an evaporating fan of the invention.

The evaporating fan illustrated in FIG. 1 has as its source of motive power an electric motor 1. A light blade wheel 3, which is mainly of carbon-fibre-based composite material, is mounted directly on the rotor shaft 2 of the electric motor without separate bearings. This direct mounting means that only the bearings of the electric motor 1 are used for mounting the whole fan arrangement.

Figure 3:
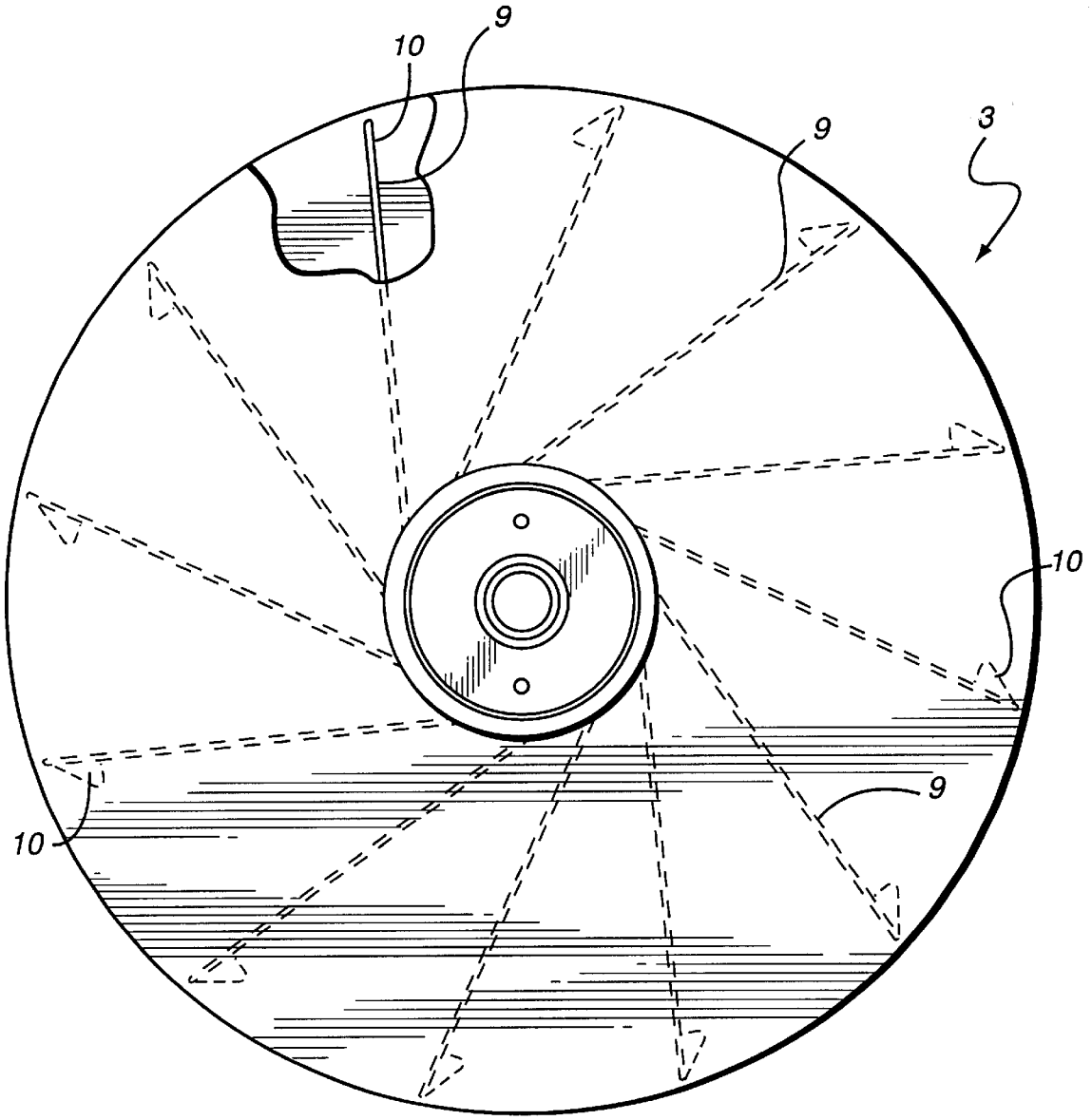
FIG. 3 shows a partially sectional side view of the blade wheel shown in the previous figures.

FIGS. 2 and 3 show a more detailed view of the blade wheel 2, which comprises several blades 9 mounted between the end plates 7 and 8. Both the end plates 7 and 8 and the blades 9 are of carbon-fibre-based composite material. The hub 4, 5 of the blade wheel is of steel in this example, but it could also be made of the above-mentioned composite material. In order to protect the tips of the blades against erosion, a metal shield plate 10 is arranged around the tip of each blade, the shield plate 10 covering both sides of the tips. This shield plate 10 is preferably made of steel, although another metal resisting corrosion and wear may also be used. The shield plate 10 is glued onto the tip of the blade 9, and the critical sections of the shield plate are fastened with rivets 6 both to the tip of the blade 9 and to the end plates 7 and 8.

Alternatively, the tips of the blades 9 can be shielded against erosion and wear by coating the critical sections (which may also include the parts of the end plates 7 and 8 near the blade tips) with spreadable ceramic coating (see 11 in FIG. 2A).

The invention has been described above only by means of one preferred embodiment of it. One skilled in the art can, however, implement the fan of the invention and its details in several alternative ways within the scope of the appended claims.

What is claimed is:

1. A mechanical vapor recompression fan for raising the pressure of a process vapor, the fan comprising a blade wheel and a motor, said motor having a shaft on which said blade wheel is directly mounted without bearings; said blade wheel including a plurality of blades arranged between a pair of end plates, each blade constructed of carbon-fiber-based composite material, and each blade having a tip provided with an erosion shield for prevention liquid drop erosion.

2. An evaporating fan as claimed in claim 1 wherein the erosion shield comprises metal reinforcements fixed to the tips of the blades.

3. An evaporating fan as claimed in claim 2 wherein the metal reinforcements are bent around the tips, covering both sides thereof.

4. An evaporating fan as claimed in claim 2 wherein the metal reinforcements are of steel.

5. An evaporating fan as claimed in claim 1 wherein the erosion shield comprises ceramic coating spread on the tips of the blades.

* * * * *

UNITED STATES PATENT AND TRADEMARK OFFICE

CERTIFICATE OF CORRECTION

PATENT NO. : 6,264,430 B1
DATED : July 24, 2001
INVENTOR(S) : Hulkkonen et al.

It is certified that error appears in the above-identified patent and that said Letters Patent is hereby corrected as shown below:

Title page,
Item [73], delete Assignee: "ABB Flakt Oy" and insert -- ABB Fläkt Oy --;
Insert the following INID Codes and information:
-- [86] PCT No.: PCT/FI98/00035
§ 371 Date: July 2, 1999
§ 102(e) Date: July 2, 1999

[86] PCT Pub. No.: WO98/31938
PCT Pub. Date: July 23, 1998 --

Signed and Sealed this

Twenty-third Day of July, 2002

*Attest:*

*Attesting Officer*

JAMES E. ROGAN
*Director of the United States Patent and Trademark Office*